US005977719A

United States Patent [19]

Makishima

[11] Patent Number: 5,977,719

[45] Date of Patent: Nov. 2, 1999

[54] FIELD EMISSION CATHODE TYPE ELECTRON GUN WITH INDIVIDUALLY-CONTROLLED CATHODE SEGMENTS

[75] Inventor: Hideo Makishima, Tokyo, Japan

[73] Assignee: NEC Corporation, Tokyo, Japan

[21] Appl. No.: 08/937,615

[22] Filed: Sep. 25, 1997

[30] Foreign Application Priority Data

Sep. 27, 1996 [JP] Japan ..... 8-256426

[51] Int. Cl.[6] ..... H05B 37/02

[52] U.S. Cl. ..... 315/169.1; 315/307

[58] Field of Search ..... 315/169.1, 169.3, 315/307

[56] References Cited

U.S. PATENT DOCUMENTS

| | | | |
|---|---|---|---|
| 5,103,145 | 4/1992 | Doran | 315/381 |
| 5,359,256 | 10/1994 | Gray | 313/169 |
| 5,552,677 | 9/1996 | Pagones | 315/169.1 |
| 5,578,906 | 11/1996 | Smith | 315/169.1 |
| 5,700,175 | 12/1997 | Wang et al. | 315/169.1 |

OTHER PUBLICATIONS

Abstract of JP–A8087957.
Abstract of JP–A6243777.
Abstract of JP–A534000.

C. A. Spindt, "A Thin–Film Field Emission Cathode" Journal of Applied Physics, vol. 39, No. 7, pp. 3504–3505, Jun. 1968.

English abstract of JP 5343000.

English abstract of JP 7235258.

English abstract of JP 887957.

Patent Abstracts of Japan, vol. 096, No. 008, Aug. 30, 1996, & JP 08 087957 (Alps Electric Co., Ltd.) Apr. 2, 1996.

Patent Abstracts of Japan, vol. 018, No. 167 (E–1528), Mar. 22, 1994 & JP 05 343000 (Futaba Corp) Dec. 24, 1993.

*Primary Examiner*—Michael B Shingleton
*Attorney, Agent, or Firm*—Sughrue, Mion, Zinn, Macpeak & Seas, PLLC

[57] ABSTRACT

In a field emission cathode type electron gun, a plurality of cathode segments and a plurality of gate control circuits are provided. Each of the gate control circuits is connected to one of the cathode segments. Each of the cathode segments includes a cathode electrode, a gate electrode, an insulating layer therebetween, and a plurality of cone-shaped emitters formed within openings perforated in the gate electrode and the insulating layer. Each of the gate control circuits detects a current flowing through one of the cathode segments and controls a voltage of the gate electrode of the respective cathode segments in accordance with the detected current, so that the detected current is brought close to a definite value.

15 Claims, 16 Drawing Sheets

FIELD EMISSION CATHODE TYPE ELECTRON GUN WITH INDIVIDUALLY-CONTROLLED CATHODE SEGMENTS

BACKGROUND OF THE INVENTION

1. Field of the Invention

The present invention relates to a field emission cathode (FEC) type electron gun.

2. Description of the Related Art

In a first type of conventional FEC type electron gun, a cold cathode is constructed of one substrate (cathode electrode), one gate electrode, an insulating layer therebetween, and a plurality of cone-shaped emitters formed within openings perforated in the gate electrode and the insulating layer. If a high voltage is applied between the gate electrode and the cone-shaped emitters, a strong electric field is generated around the tips of the cone-shaped emitters, so that electrons are emitted therefrom. (see: C. A. Spindt, "A Thin-Film Field-Emission Cathode", Journal of Applied Physics, Vol. 39, No. 7, pp. 3504–3505, June 1968). This will be explained later in detail.

The above-described FEC type electron gun has an advantage in that a high density of current is realized and the velocity of dispersion of emitted electrons is small as compared with a conventional thermionic cathode electron gun.

Also, in order to effectively converge an electron beam emitted from the electron gun, focusing electrodes are provided (see: JP-A-5-343000 and JP-A-7-235258). This will also be explained later in detail.

In a second type of conventional FEC type electron gun, in order to obtain a stable electron beam, a field effect transistor (FET) is incorporated as a constant current source into the same substrate as the cold cathode (see: JP-A-8-87957). This will also explained later in detail.

In a third type of conventional FEC type electron gun, the driving system of the second type of FEC type electron gun is applied to a plurality of cold cathode elements. This will also be explained later in detail.

In the third FEC type electron gun, however, since all the cold cathode elements are controlled by a single FET, each of the emission currents of the cold cathode elements fluctuates, and as a result, the distribution of current density within the entire cold cathode is fluctuates with time, and thus, a stable electron beam cannot be obtained.

SUMMARY OF THE INVENTION

It is an object of the present invention to provide an FEC type electron gun capable of generating an electron beam having a uniform current density distribution.

According to the present invention, in an FEC type electron gun, a plurality of cathode segments and a plurality of gate control circuits are provided. Each of the gate control circuits is connected to one of the cathode segments. Each of the cathode segments includes a cathode electrode a gate electrode an insulating layer therebetween, and a plurality of cone-shaped emitters formed within openings perforated in the gate electrode and the insulating layer. Each of the gate control circuits detects a current flowing through one of the cathode segments and controls a voltage of the said gate electrode of the respective cathode segment in accordance with the detected current, so that the detected current is of a constant value.

Thus, the cathode segments are individually controlled by the gate control circuits, thus making the distribution of current density of an electron beam uniform.

BRIEF DESCRIPTION OF THE DRAWINGS

The present invention will be more clearly understood from the description as set forth below, in comparison with the prior art, with reference to the accompanying drawings, wherein.

DESCRIPTION OF THE PREFERRED EMBODIMENTS

Before the description of the preferred embodiments, conventional FEC type electron guns will be explained with reference to FIGS. 1A, 1B, 2A, 2B, 3A, 3B and 4.

Figure 1A:
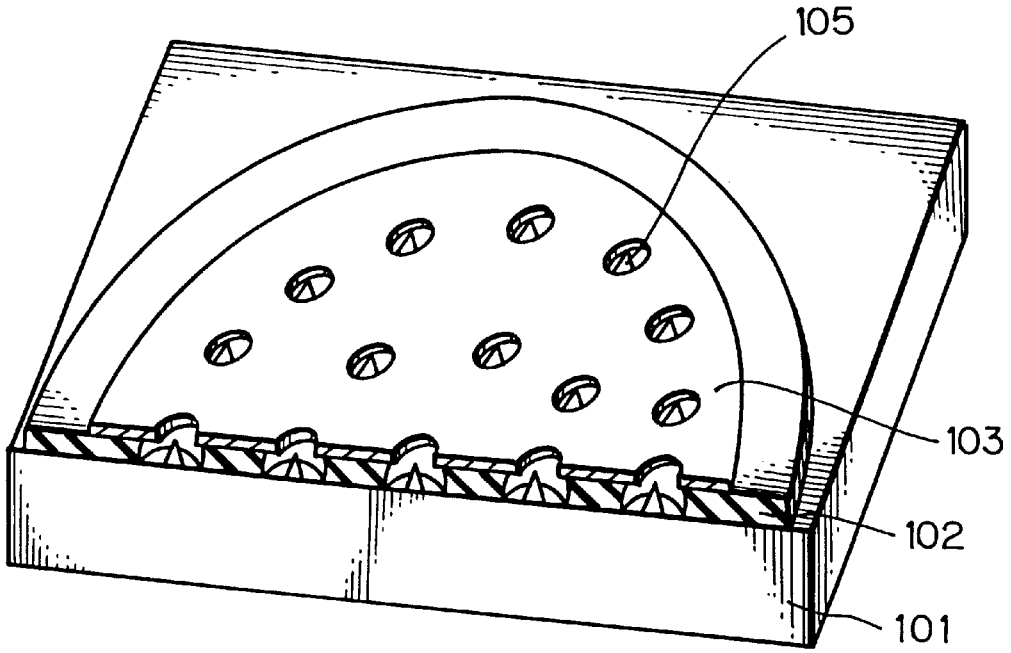
Fig. 1A PRIOR ART
FIG. 1A is a partly-cut perspective view illustrating a cold cathode of a first conventional FEC type electron gun.
Figure 1B:
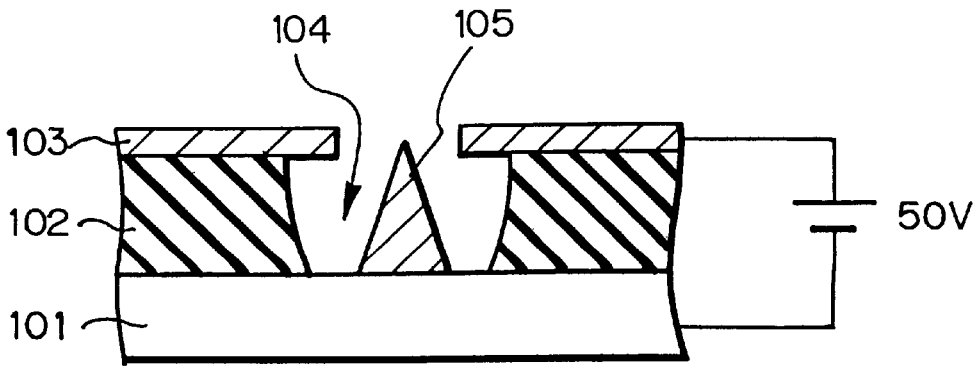
Fig. 1B PRIOR ART
FIG. 1B is a partial cross-sectional view of the electron gun of FIG. 1A.

FIG. 1A is a partly-cut perspective view illustrating a cold cathode of a first type of conventional FEC type electron gun, and FIG. 1B is a partial cross-sectional view of one cold cathode element of the electron gun of FIG. 1A (see: C. A. Spindt, "A Thin-Film Field-Emission Cathode", Journal of Applied Physics, Vol. 39, No. 7, pp. 3504–3505, June 1968). In FIGS. 1A and 1B, reference numeral 101 designates a silicon substrate on which an about 1 $\mu$m thick silicon oxide layer 102 and a gate electrode 103 are formed. A plurality of openings 104 are perforated in the gate electrode 103 and the silicon oxide layer 102, and a plurality of cone-shaped emitters 105 are formed within on the silicon substrate 101 and extend into the openings 104. One of the cone-shaped emitters 105 and the gate electrode 103 form one cold cathode element.

For example, a diameter of each of the openings 104 at the gate electrode 103 is about 1 $\mu$m, and a diameter of the tip of each of the cone-shaped emitters 105 is about 1 nm. In this case, if a voltage of about 50V is applied between the gate electrode 103 and the cone-shaped emitters 105, a strong electric field of about 2 to $5\times10^7$ V/cm is generated around the tips of the cone-shaped emitters 105, so that electrons are emitted therefrom. If the of cone-shaped emitters 105 are arranged on the silicon substrate 101 in a high density manner by using a photolithography and etching process, a high current density electron gun can be realized. For example, the current density of the FEC type electron gun can be as much as five to ten times larger than that of the conventional thermionic cathode electron gun.

Figure 2A:
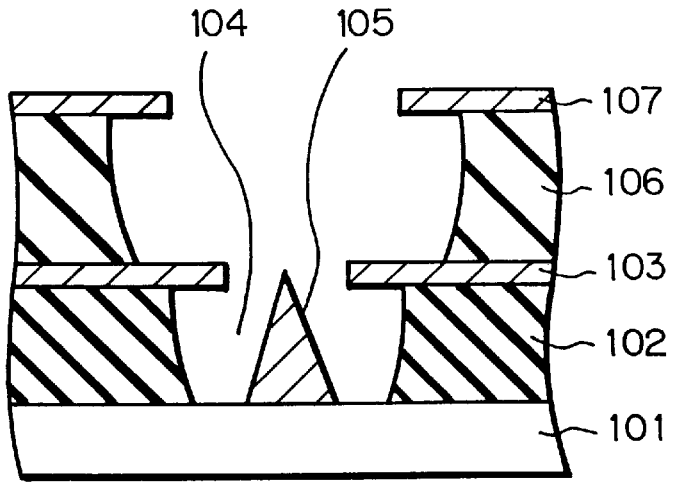
Fig. 2A PRIOR ART
FIGS. 2A and 2B are cross-sectional views illustrating modifications of the electron gun of FIG. 1B.
Figure 2B:
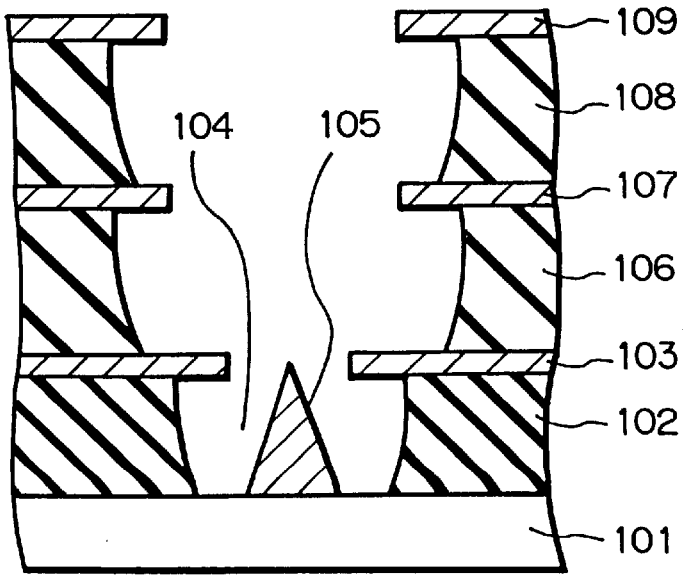
Fig. 2B PRIOR ART

In FIG. 2A, which is a modification of the cold cathode element of FIG. 1B, an insulating layer 106 and a focusing electrode 107 are provided. Also, in FIG. 2B, which is another modification of the cold cathode element of FIG. 1B, an insulating layer 108 and a focusing electrode 109 are further provided (see: JP-A-5-343000 and JP-A-7-235-258). Thus, if an appropriate DC voltage is applied to the focusing electrode 107 (109), the electron beam emitted from the cone-shaped emitters 105 can be converged.

Figure 3A:
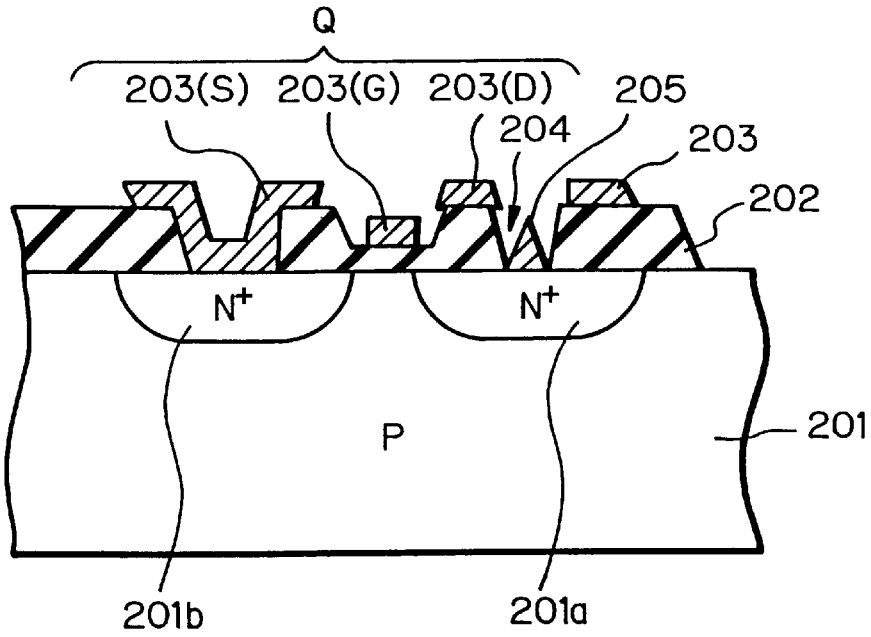
Fig. 3A PRIOR ART
FIG. 3A is a cross-sectional view illustrating a cold cathode of a second conventional FEC type electron gun.
Figure 3B:
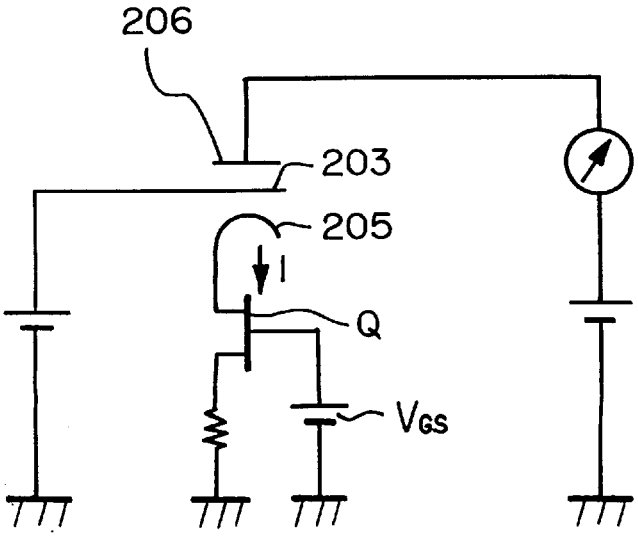
Fig. 3B PRIOR ART
FIG. 3B is an equivalent circuit diagram of the electron gun of FIG. 3A.

FIG. 3A is a cross-sectional view illustrating a cold cathode of a second type of conventional FEC type electron gun, and FIG. 3B is an equivalent circuit diagram (see: JP-A-8-87957). In FIG. 3A, elements 201 to 205 correspond to the silicon substrate 101, the silicon oxide layer 102, the gate electrode 103, the opening 104 and the cone-shaped emitter 105, respectively, of FIG. 1B. Also, in FIG. 3A, reference numerals 201*a* and 201*b* designate impurity diffusion regions formed within the silicon substrate 201, and 203(S), 203(G) and 203(D) designate a source electrode, a gate electrode and a drain electrode, respectively, of an FET Q. Note that the drain electrode 203(D) serves as the gate electrode of the cold cathode element. Also, the electrodes 203, 203(S), 203(G) and (D) can be made of the same material. As illustrated in FIG. 3B, the FET Q is connected as a constant current source to the cone-shaped emitter 205. Therefore, when a gate-to-source voltage $V_{GS}$ of the FET Q is constant, an electron beam current I is always constant even if the surface state of the tip of the cone-shaped emitter 205 fluctuates. Thus, a constant electron beam current can be obtained.

In FIG. 3B, note that reference numeral 206 designates an anode electrode.

Figure 4:
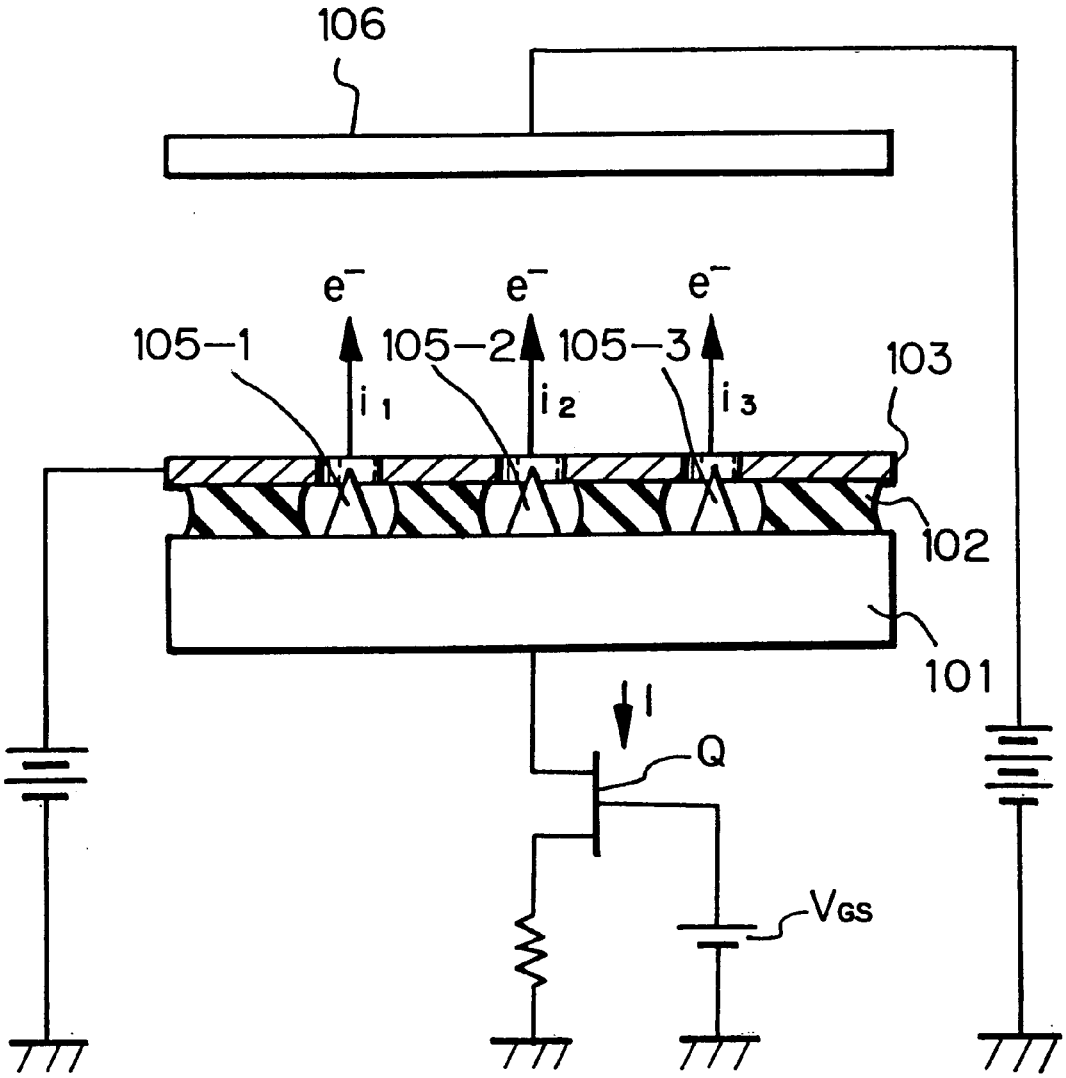
Fig. 4 PRIOR ART
FIG. 4 is a cross-sectional view illustrating a cold cathode of a third conventional FEC type electron gun.

In FIG. 4, which illustrates a third type of conventional FEC type electron gun, the driving system of the second type of conventional FEC type electron gun of FIGS. 3A and 3B is applied to a plurality of cold cathode elements. For example, three cone-shaped emitters 105-1, 105-2 and 105-3 are connected to a TFT Q which can be formed on the same substrate 101. Note that reference numeral 106 designates an anode electrode. Therefore, when a gate-to-source voltage $V_{GS}$ of the FET Q is constant, an electron beam current I is constant. In this case, the electron beam current I is represented by $$I=i1+i2+i3 \quad (1)$$

where i1, i2 and i3 are emission currents of the cone-shaped emitters 105-1, 105-2 and 105-3, respectively.

In the FEC type electron gun of FIG. 4, however, since all the cold cathode elements are controlled by the single FET Q, the emission currents i1, i2 and i3 are may fluctuate while the condition of formula (1) is satisfied. As a result, the distribution of current density within the entire cold cathode fluctuates with as time, and thus, a stable electron beam cannot be obtained. For example, if the FEC type electron gun of FIG. 4 is applied to a microwave tube, a helical current fluctuates, so that the reliability is reduced.

In addition, the FET Q is operated so that the potentials at the tips of the cone-shaped emitters 105-1, 105-2 and 105-3 fluctuates to compensate for the change of the tip shapes and the surface states of the cone-shaped emitters 105-1, 105-2 and 105-3. As a result, the DC propagation speed of the electron beam fluctuates. For example, in a microwave tube, since a signal is amplified by synchronizing an RF signal in a helical circuit with the DC propagation speed of the electron beam, the gain and output of the microwave tube fluctuate.

Figure 5:
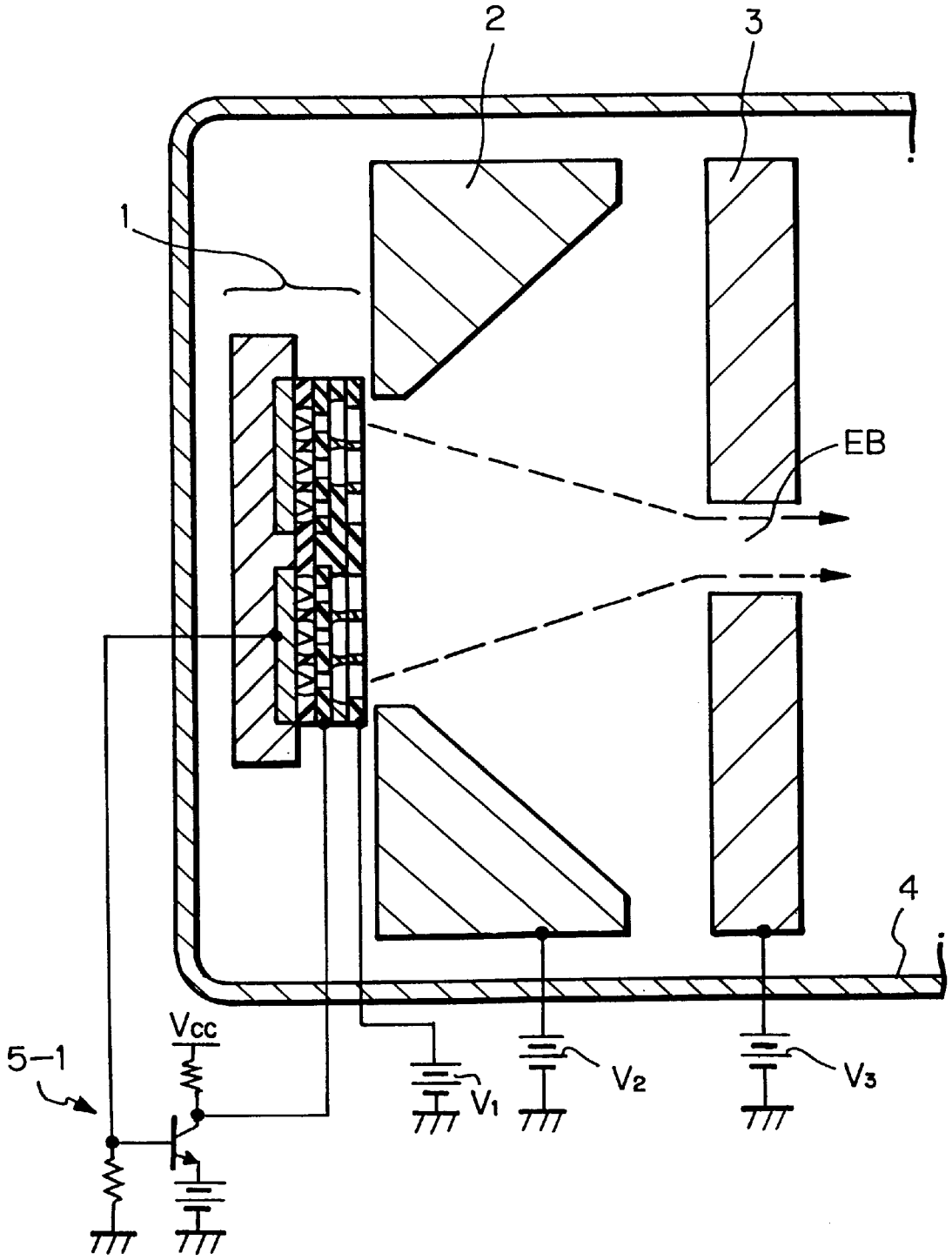
FIG. 5 is a cross-sectional view illustrating a first embodiment of the FEC type electron gun according to the present invention.

In FIG. 5, which illustrates a first embodiment of the FEC type electron gun according to the present invention, reference numeral 1 designates a cold cathode for emitting a beam EB of free electrons, 2 designates a Wehnelt electrode for converging the electron beam EB, and 3 designates an anode electrode for accelerating the electrons of the electron beam EB. The cold cathode 1, the Wehnelt electrode 2 and the anode electrode 3 are enclosed in a vacuum envelope 4.

DC voltages $V_1$, $V_2$ and $V_3$ are applied to the cold cathode 1 (particularly, the focusing electrode 16 of FIG. 6), the Wehnelt electrode 2 and the anode electrode 3, respectively. For example, $V_1$ is 0 to about 100V, $V_2$ is 0 to about 100V, and $V_3$ is about 1000 to 4000 V. For example, $V_1$=10V, $V_2$=3V, and $V_3$=2000V.

The cold cathode 1 is divided into six segments, and six gate voltage control circuits 5-1, 5-2, . . . , 5-6 are provided for the six segments. This will be explained next with reference to FIGS. 6, 7 and 8.

Figure 6:
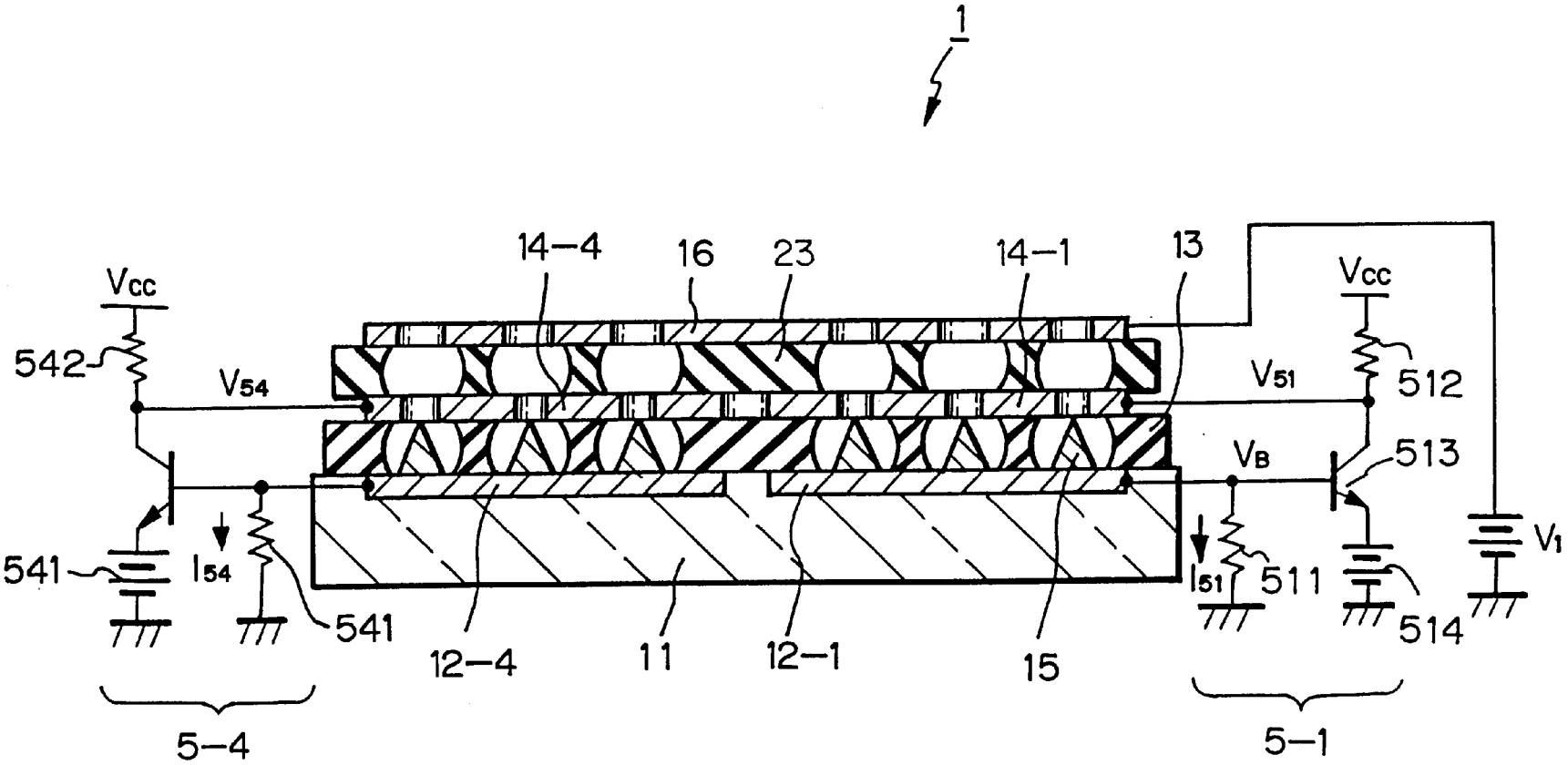
FIG. 6 is an enlarged cross-sectional view of the cold cathode of FIG. 5.
Figure 7:
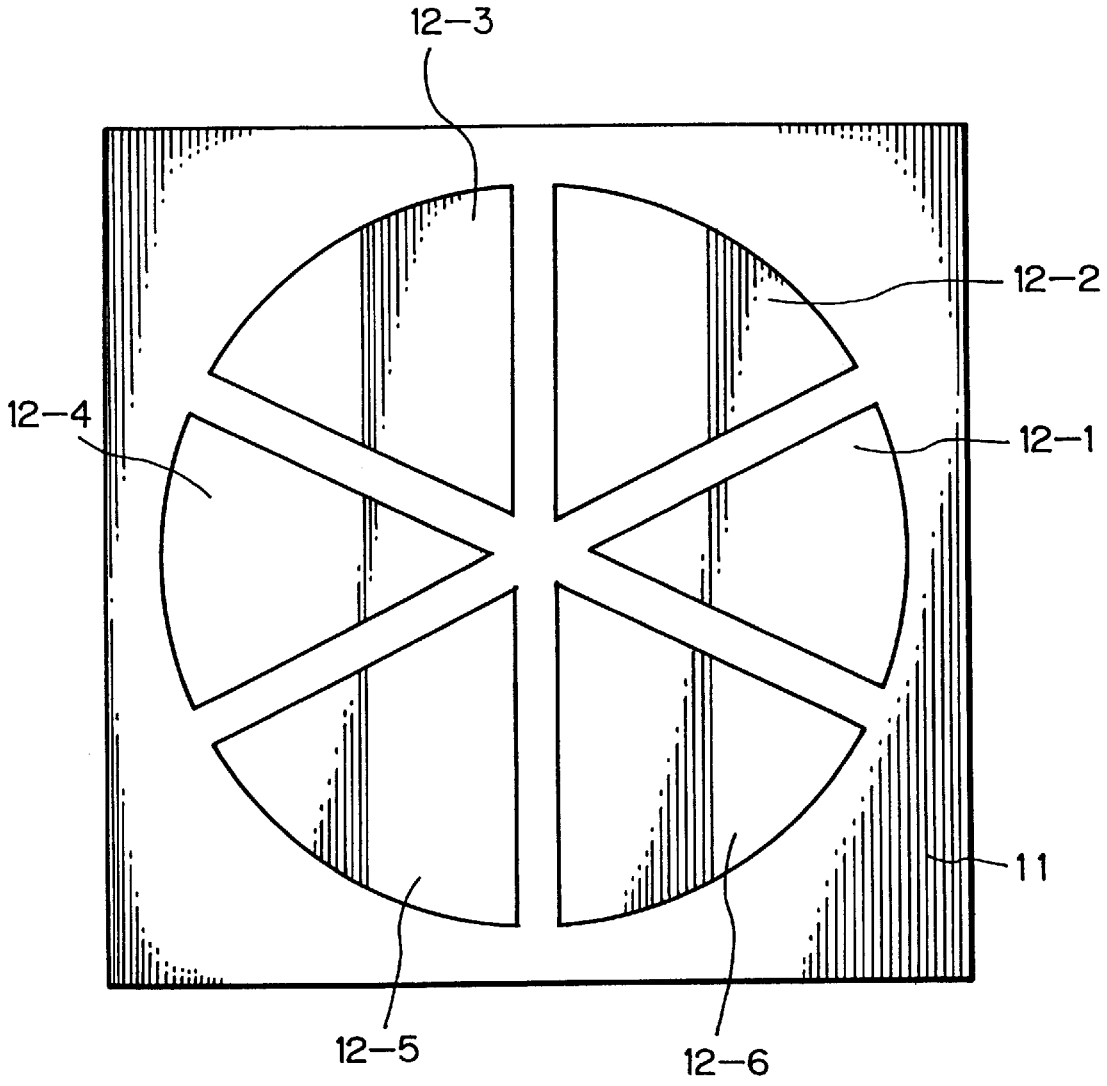
FIG. 7 is a plan view of the cathode electrodes of FIG. 6.
Figure 8:
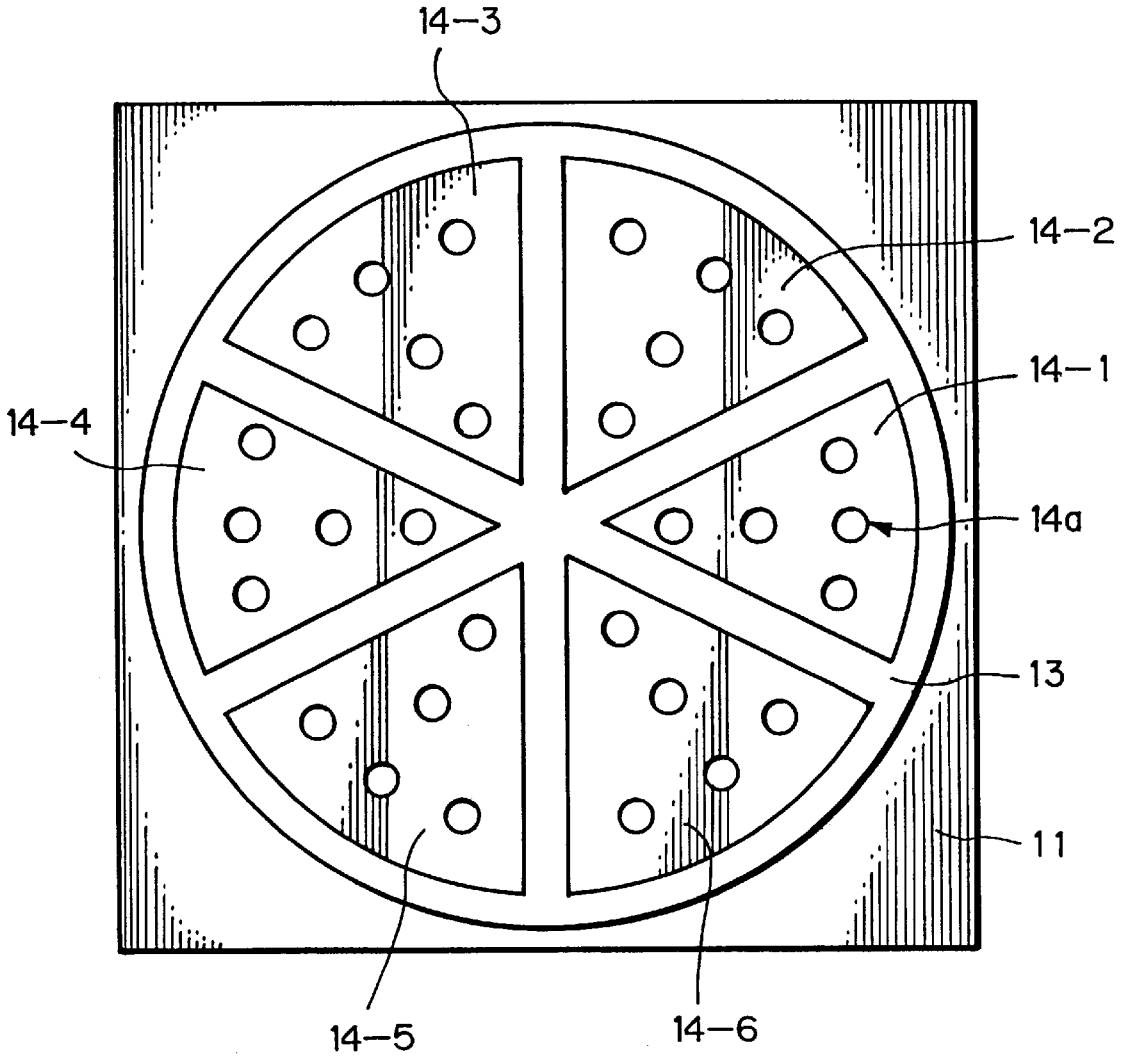
FIG. 8 is a plan view of the gate electrodes of FIG. 6.

In FIG. 6, reference numeral 11 designates an insulating substrate made of glass or the like on which cathode electrodes 12-1, 12-2, . . . , 12-6 are formed as illustrated in FIG. 7. Also, an about 0.4 to 0.8 μm thick insulating layer 13 made of silicon oxide and/or silicon nitride is formed on the cathode electrodes 12-1, 12-2, . . . , 12-6 as well as the substrate 11, and about 0.2 μm thick gate electrodes 14-1, 14-2, . . . , 14-6 made of tungsten(W), molybdenum(Mo), niobium(Nb) or tungsten silicide(WSi) are formed on the insulating layer 13, as illustrated in FIG. 8. In this case, the gate electrode 14-1, 14-2, . . . , 14-6 oppose the cathode electrodes 12-1, 12-2, . . . , 12-6, respectively.

Further, openings 14*a* (see FIG. 8) having a diameter of about 1 μm are perforated in the gate electrodes 14-1, 14-2, . . . , 14-6 and the insulating layer 13, and cone-shaped emitters 15 made of refractory metal such as W or Mo are formed on the cathode electrodes 12-1, . . . , 12-6 to extend into the openings 14*a* In this case, the height of the cone-shaped emitters is about 0.5 to 1.0 μm.

Figure 9:
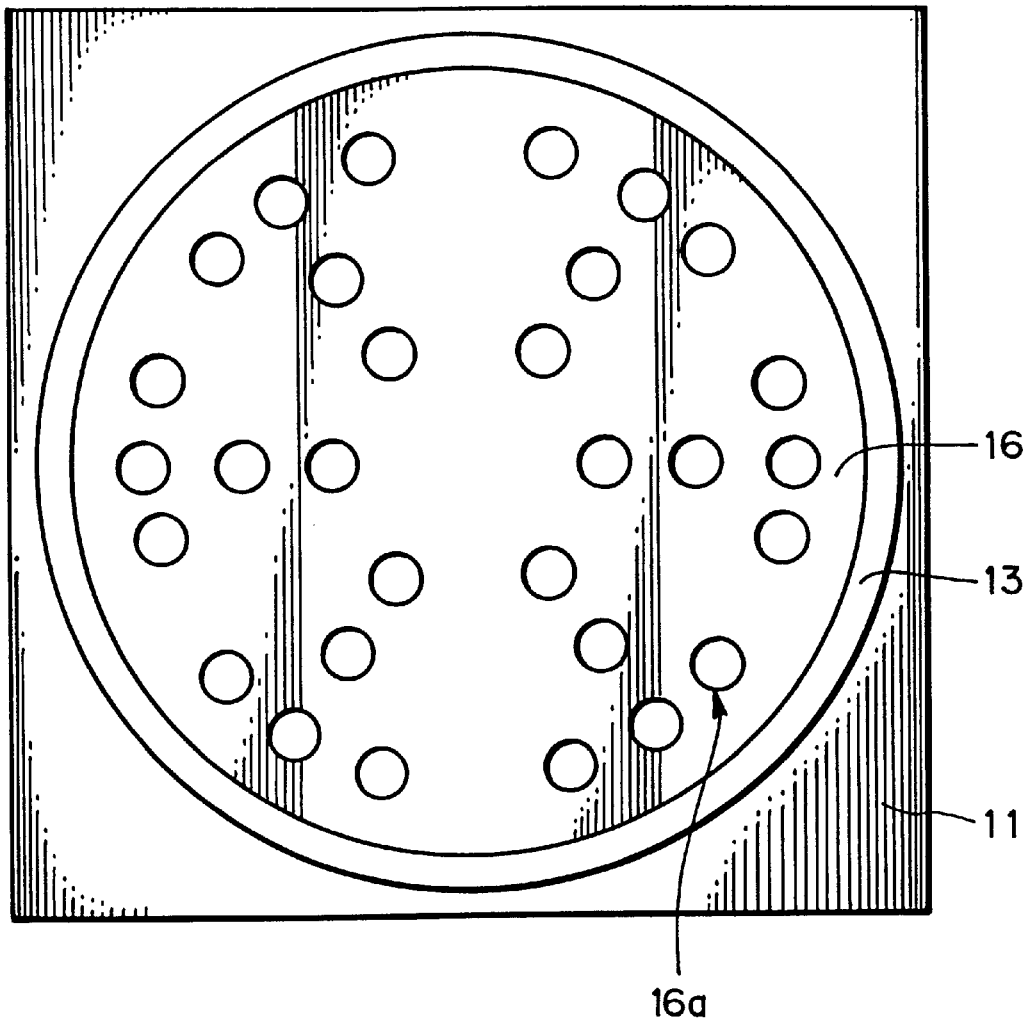
FIG. 9 is a plan view of the focusing electrode of FIG. 6.

In addition, an about 0.4 to 0.8 μm thick insulating layer 23 made of silicon oxide and/or silicon nitride and a focusing electrode 16 made of W, Mo, Nb or WSi are formed on the gate electrodes 14-1, 14-2, . . . , 14-6. In this case, openings 16*a* (see FIG. 9) corresponding to the openings 14*a* of FIG. 8 are formed in the focusing electrode 16 and the insulating layer 23.

Referring to FIG. 6, the gate control circuit such as 5-1 is connected between the cathode electrode 12-1 and the gate electrode 14-1. The gate control circuit 5-1 is formed by a resistor 511 for detecting a current flowing between the gate electrode 14-1 to the cathode electrode 12-1, a resistor 512, a transistor 513 and a reference power supply 514. In this case, the resistor 512, the transistor 513 and the reference power supply 514 form a constant current control circuit. That is, if a current $I_{51}$ flowing through the cathode 12-1 is increased, the base voltage $V_B$ of the transistor 513 is increased, so that the voltage $V_{51}$ at the gate electrode 14-1 is decreased. On the other hand, if the current $I_{51}$ flowing through the cathode 12-1 is decreased, the base voltage $V_B$ of the transistor 513 is decreased, so that the voltage $V_{51}$ at the gate electrode 14-1 is increased. Thus, since the base voltage $V_B$ is brought close to a voltage of $V_R$ plus $V_{BE}$ where $V_R$ is the voltage of the reference voltage supply 514 and $V_{BE}$ is a base-emitter voltage of the transistor 513, the current $I_{51}$ is controlled close to a constant value. In this case, the voltage $V_{51}$ is brought close to about 50V, for example. Therefore, the change of the surface state of the tips of the cone-shaped emitters 15 formed on the cathode electrode 12-1 is compensated for by the gate control circuit 5-1.

Since the current flowing through each of the cathode electrodes 12-1, 12-2, . . . , 12-6 is constant, a total current flowing $I(=I_{51}+I_{52}+\ldots+I_{56})$ through the cathode electrodes 12-1, 12-2, . . . , 12-6 is also constant. Also, the density of current flowing through the cathode electrodes 12-1, 12-2, . . . , 12-6 can be uniform. Note that, if the number of cathode electrodes is increased, the distribution of current flowing through all of the cathode electrodes can be further uniform. Therefore, the reference potential at the electron beam can be always constant over the cathode electrodes 12-1, 12-2, . . . , 12-6, and accordingly, for example, in a microwave tube, the DC propagation speed can be definite, thus avoiding the generation of spurious noise and the reduction of the gain.

Also, the speed of electrons emitted from the cone-shaped emitters 15 can be made constant by the focusing electrode 16, and then, the electrons are incident to the Wehnelt electrode 2 and the anode electrode 3 of FIG. 5.

Thus, in the first embodiment, although the voltages at the gate electrodes 14-1, 14-2, . . . , 14-6 are individually changed by the gate control circuits 5-1, 5-2, . . . , 5-6, the electron beam EB of FIG. 5 is uniform.

Figure 10:
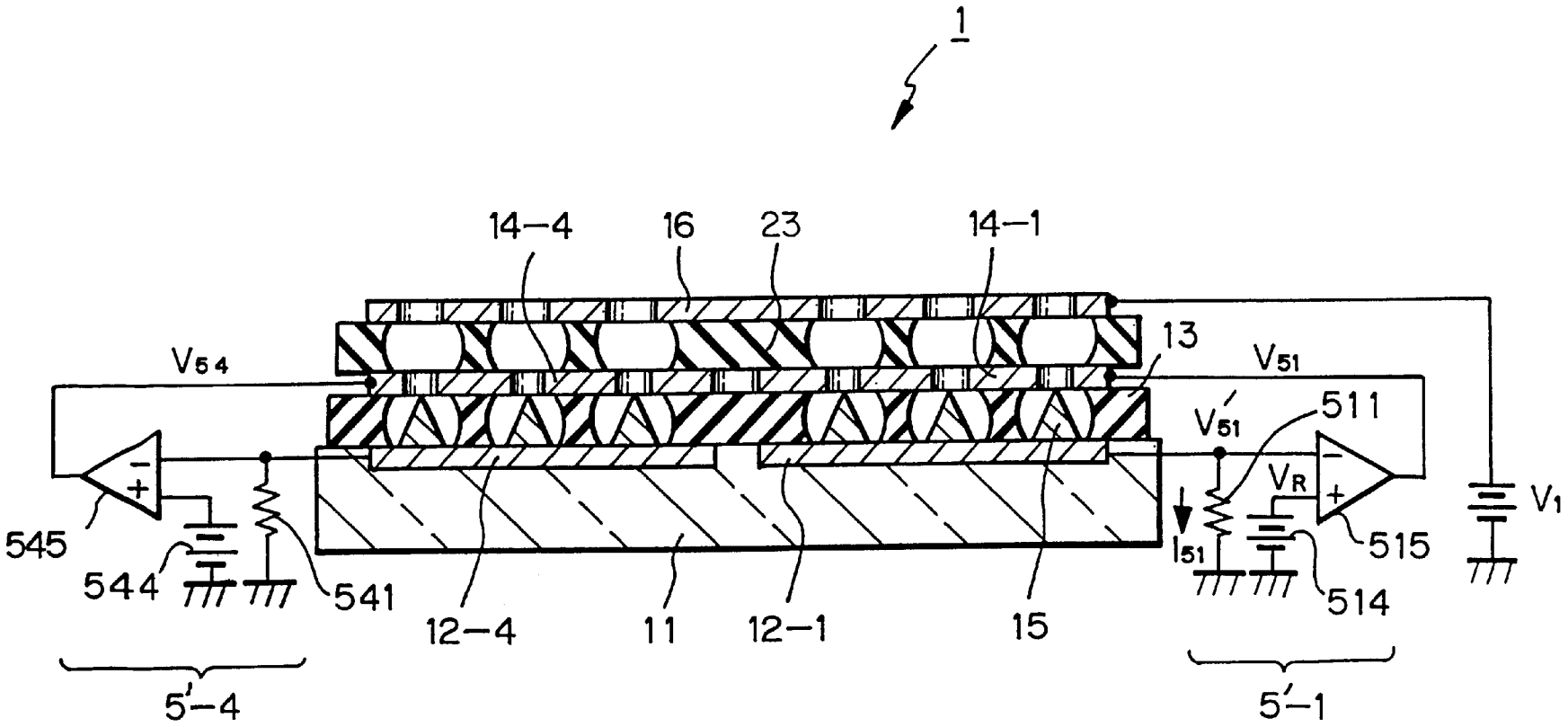
FIG. 10 is a cross-sectional view illustrating a second embodiment of the FEC type electron gun according to the present invention.

In FIG. 10, which illustrates a second embodiment of the present invention, the gate control circuit 5-1 (5-2, . . . , 5-6) of FIG. 6 is modified to a gate control circuit 5'-1 (5'-2, . . . , 5'-6). The control circuit 5'-1 includes an operational amplifier 515 instead of the resistor 512 and the transistor 513 of FIG. 6. That is, if a current $I_{51}$ flowing through the cathode 12-1 is increased, the voltage $V_{51}'$ of the operational amplifier 515 is increased ($V_{51}'>V_R$), so that the voltage $V_{51}$ at the gate electrode 14-1 is decreased. On the other hand, if the current $I_{51}$ flowing through the cathode 12-1 is decreased, the voltage $V_{51}'$ of the operational amplifier 515 is decreased, so that the voltage $V_{51}$ at the gate electrode 14-1 is increased. Thus, since the voltage $V_{51}'$ is brought close to $V_R$, the current $I_{51}$ is controlled close to a definite value. In this case, the voltage $V_{51}$ is brought close to about 50V, for example. Therefore, the change of the surface state of the tips of the cone-shaped emitters 15 formed on the cathode electrode 12-1 is compensated for by the gate control circuit 5-1.

Figure 11:
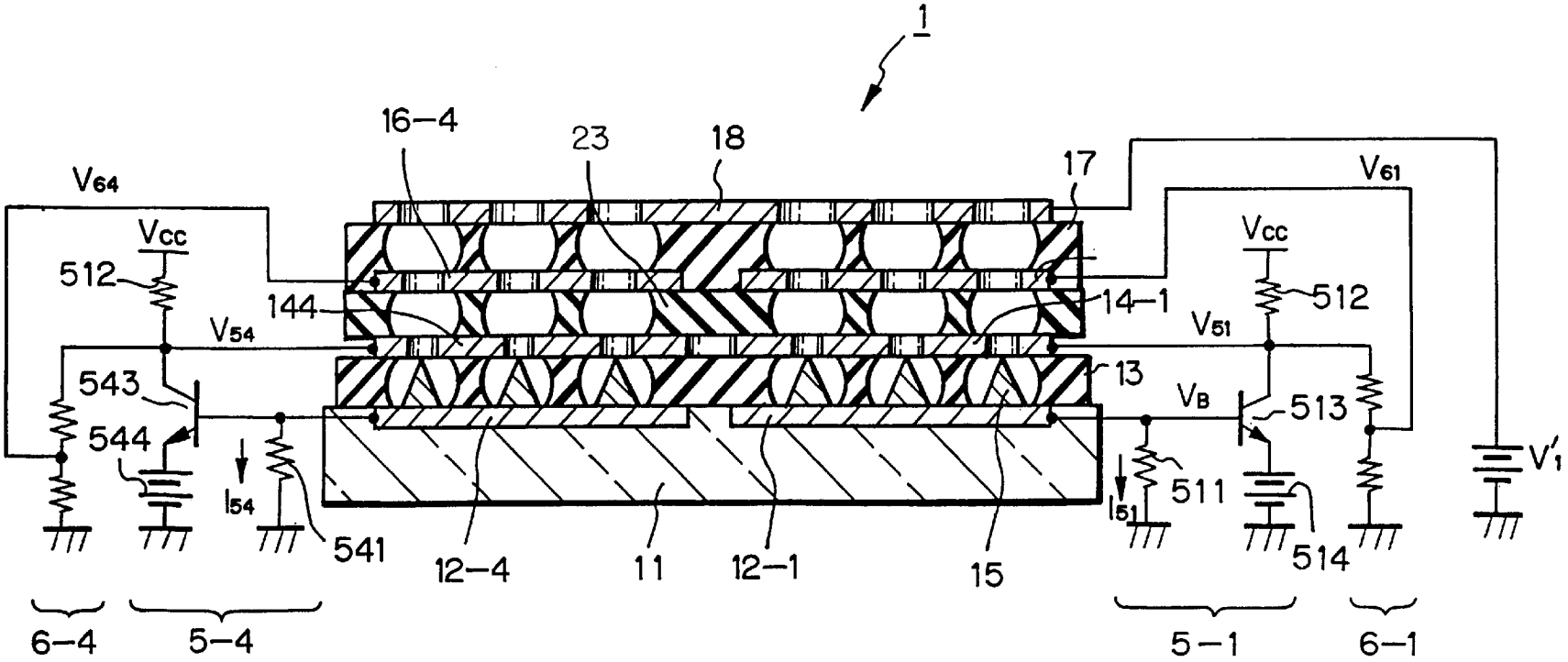
FIG. 11 is a cross-sectional view illustrating a third embodiment of the FEC type electron gun according to the present invention.
Figure 12:
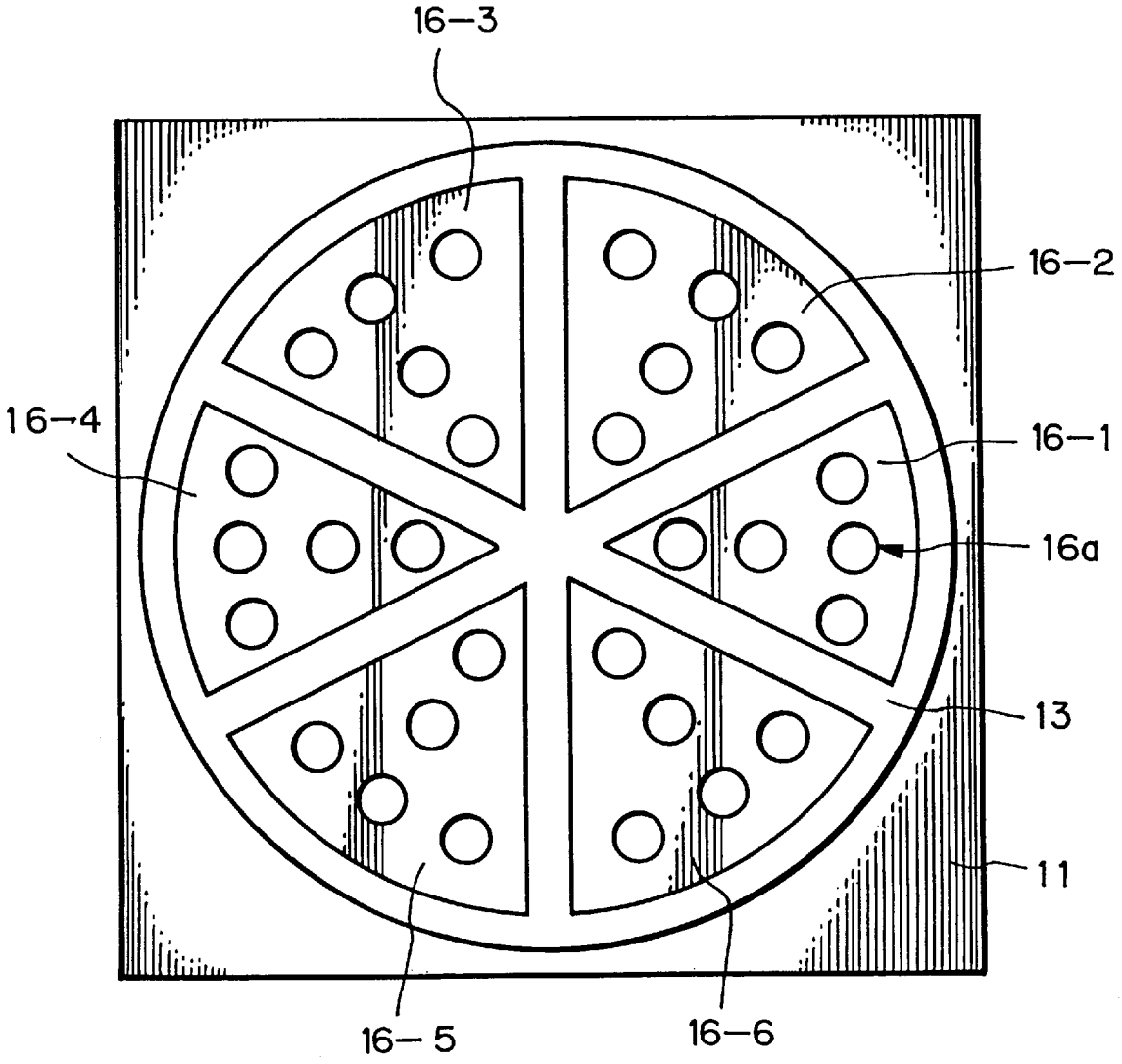
FIG. 12 is a plan view of the focusing electrodes of FIG. 11.
Figure 13:
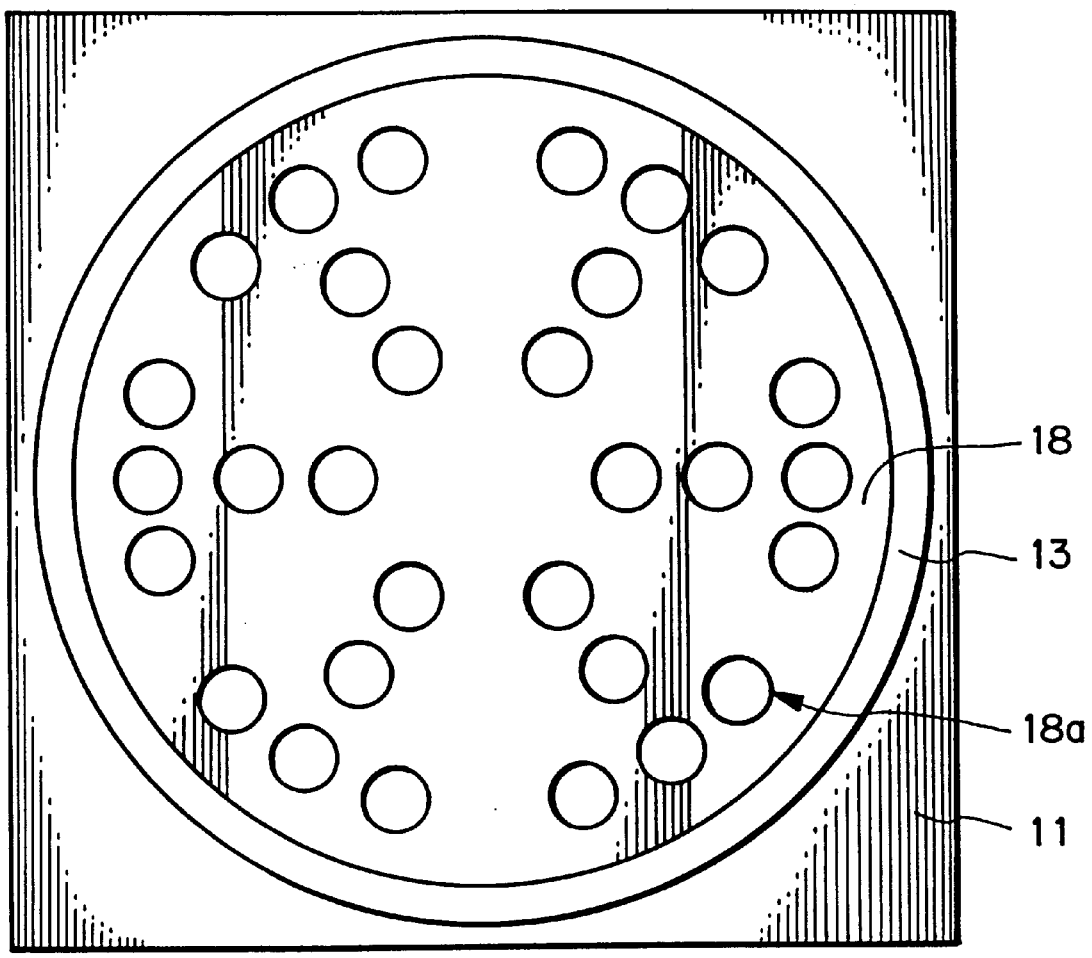
FIG. 13 is a plan view of the additional focusing electrode of FIG. 11.

In FIG. 11, which illustrates a third embodiment of the present invention, the focusing electrode 16 of FIG. 6 is divided into six focusing electrodes 16-1, 16-2, . . . , 16-6, as illustrated in FIG. 12. In addition, an about 0.4 to 0.8 $\mu$m thick insulating layer 17 made of silicon oxide and/or silicon nitride and an additional focusing electrode 18 made of W, Mo, Nb or WSi are formed on the focusing electrodes 16-1, 16-2, . . . , 16-6. In this case, openings 18*a* (see FIG. 13) corresponding to the openings 16*a* of FIG. 12 are formed in the additional focusing electrode 18 and the insulating layer 17.

In FIG. 11, a DC voltage $V_1'$ applied to the additional focusing electrode 18 is about 30V. On the other hand, a DC voltage $V_{61}$ applied to the focusing electrode 16-1 is an intermediate voltage of the gate voltage $V_{51}$ generated from a voltage divider 6-1. As a result, even when the gate voltage $V_{51}$ at the gate electrode 14-1 is changed, a focusing condition determined by the difference in voltage between the gate electrode 14-1 and the focusing electrode 16-1 is not changed. Note that this FIG. 14 configuration prevents a problem that, when the voltage $V_{51}$ at the gate electrode 14-1 is changed while the voltage $V_{61}$ of the focusing electrode 16-1 is kept constant, the focusing condition determined by the difference in potential between the gate electrode 14-1 and the focusing electrode 16-1 is also changed, which causes a ripple in the electron beam.

Figure 14:
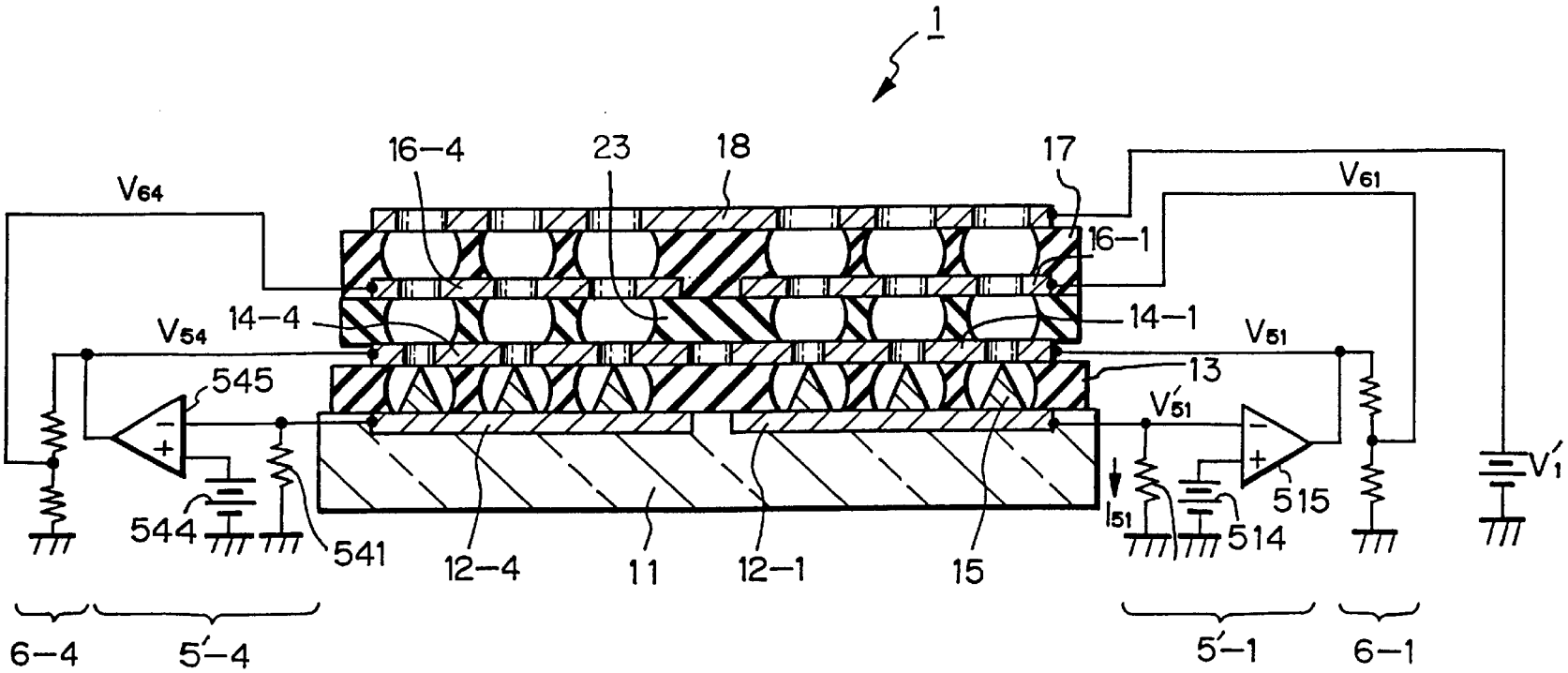
FIG. 14 is a cross-sectional view illustrating a fourth embodiment of the FEC type electron gun according to the present invention.

In FIG. 14, which illustrates a fourth embodiment of the present invention, the gate control 35 circuit 5-1 (5-2, . . . , 5-6) of FIG. 11 is replaced by the gate control circuit 5'-1 (5'-2, . . . , 5'-6) of FIG. 10. The operation of the cold cathode of FIG. 14 is the same as that of the cold cathode of FIG. 11.

Figure 15:
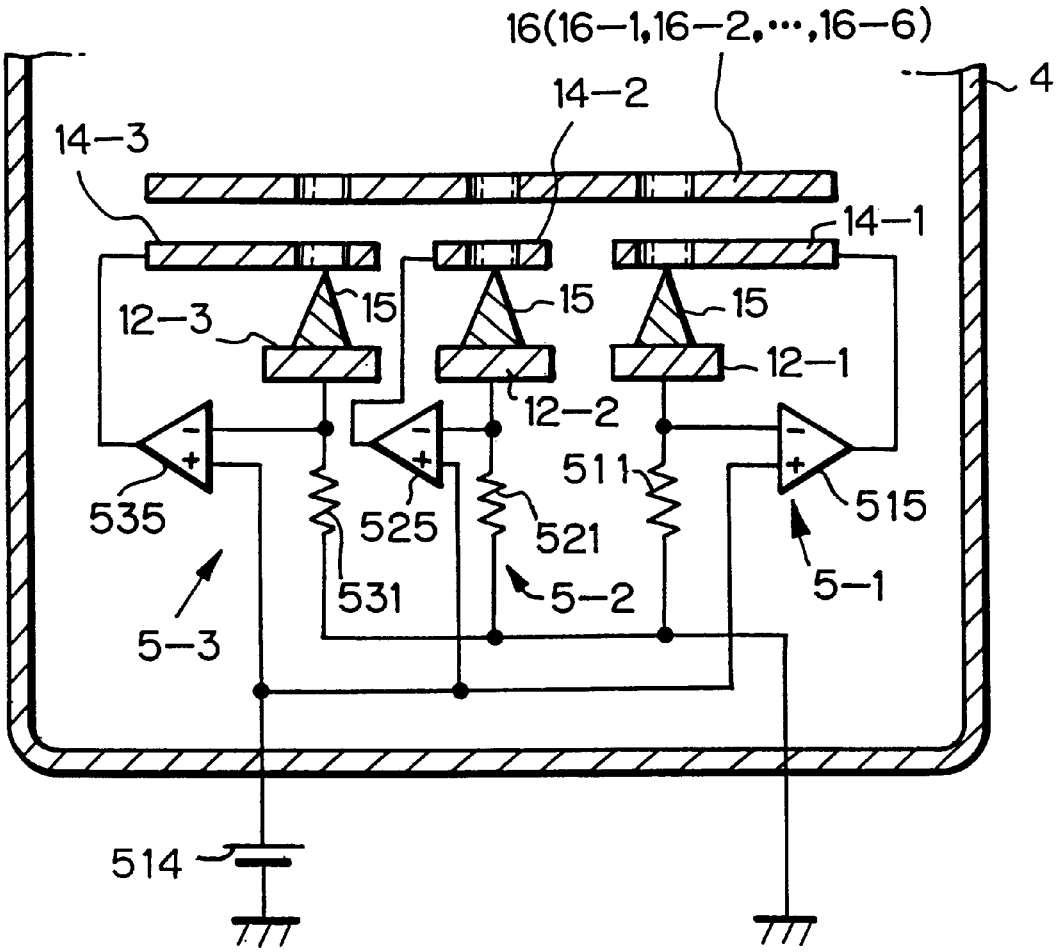
FIGS. 15 and 16 are diagrams illustrating modifications of the embodiments of the present invention.
Figure 16:
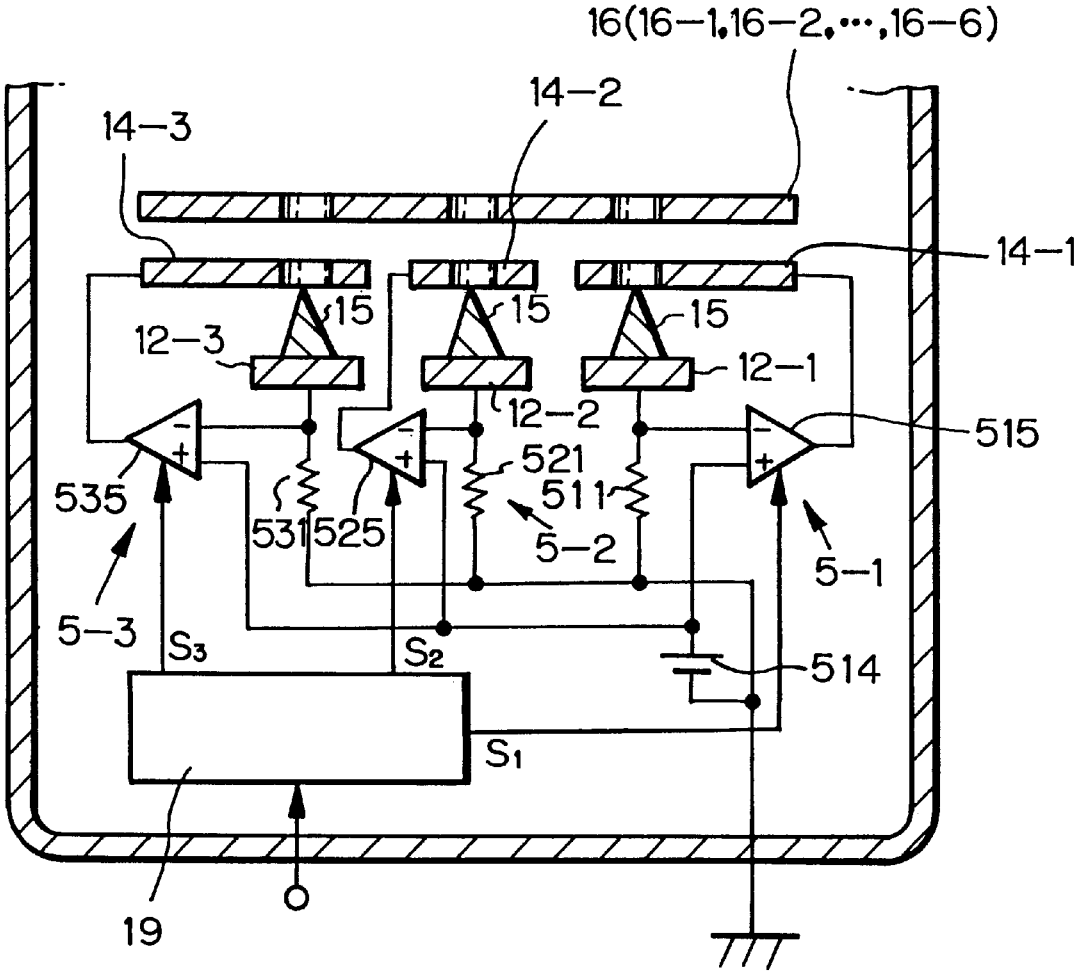

In the above-mentioned embodiments, although one reference voltage supply such as 514 is incorporated into each of the gate control circuits 5-1, 5-2, . . . , 5-6 (5'-1, 5'-2, . . . , 5'-6), only one reference voltage supply 514 can be provided commonly for the gate control circuits 5-1, 5-2, . . . , 5-6 (5'-1, 5'-2, . . . , 5'-6), as illustrated in FIG. 15. In this case, the electron beam can be controlled by adjusting only one reference voltage supply 514. Also, as illustrated in FIG. 15, the gate control circuit 5-1, 5-2, . . . , 5-6 (5'-1, 5'-2, . . . , 5'-6) can be located within the vacuum envelope 4, thus reducing the connections. Further, the gate control circuits 5-1, 5-2, . . . , 5-6 (5'-1, 5'-2, . . . , 5'-6) can be integrated into the substrate 11. Further, the gain of the operational amplifier 515, 525, . . . , 565 can be independently controlled by a control circuit 19 as illustrated in FIG. 16. For example, the control circuit 19 includes six digital-to-analog (D/A) converters for generating control signals $S_1$, $S_2$, . . . .

Note that the present invention can be applied to a Gray type cold cathode where cone-shaped emitters are formed by etching a semiconductor substrate. In this case, the substrate 11 is formed by a P-type semiconductor substrate and the cathode electrodes 12-1, 12-2, . . . , 12-6 are formed by a $N^+$-type semiconductor layers. Also, the present invention can be applied to a mold type cold cathode where cone-shaped emitters are formed by depositing electron emitting layers in small molds.

As explained hereinabove, according to the present invention, the cathode electrode and the gate electrode are divided into a plurality of segments which are individually controlled, the distribution of current density can be uniform over the all of the cathodes, thus obtaining a stable electron beam.

I claim:

1. A field emission cathode type electron gun comprising:

a substrate;

a plurality of cathode electrodes electrically-isolated and formed on said substrate;

a first insulating layer formed on said cathode electrodes;

a plurality of gate electrodes formed on said first insulating layer, each of said gate electrodes opposing one of said cathode electrodes, first openings being formed in said gate electrodes and said first insulating layer;

a plurality of cone-shaped emitters each formed within one of said first openings on one of said cathode electrodes; and a plurality of gate control circuits, each of said gate control circuits being connected between one of said cathode electrodes and one of said gate electrodes opposing a corresponding one of said cathode electrodes, for detecting a current flowing between said one of said gate electrodes and said corresponding one of said cathode electrodes and controlling a voltage of said one of said gate electrodes in accordance with said detected current, so that said detected current is brought close to a constant value.

2. A field emission cathode type electron gun as set forth in claim 1, wherein each of said gate control circuits comprises:

a first resistor connected between said one of said cathode electrodes and a ground terminal;

a second resistor connected between said one of said gate electrodes and a power supply terminal;

a transistor having a collector connected to said one of said gate electrodes, a base connected to said one of said cathode electrodes, and an emitter; and a reference voltage supply connected between the emitter of said transistor and said ground terminal.

3. A field emission cathode type electron gun as set forth in claim 1, wherein each of said gate control circuits comprises:

a resistor connected between said one of said cathode electrodes and a ground terminal;

an operational amplifier having a first input connected to said one of said cathode electrodes, a second input, and an output connected to said one of said gate electrodes; and a reference voltage supply connected to the second input of said operational amplifier.

4. A field emission cathode type electron gun as set forth in claim 1, further comprising:

a second insulating layer formed on said gate electrodes; and a focusing electrode formed on said second insulating layer, a constant voltage being applied to said focusing electrode, second openings being formed in said focusing electrode and said second insulating layer, each of said second openings leading to one of said first openings.

5. A field emission cathode type electron gun as set forth in claim 1, further comprising:

a second insulating layer formed on said gate electrodes; and a plurality of focusing electrodes formed on said second insulating layer, second openings being formed in said focusing electrode and said second insulating layer, each of said second openings leading to one of said first openings.

6. A field emission cathode type electron gun as set forth in claim 5, wherein each of said gate control circuits comprises:

a first resistor connected between said one of said cathode electrodes and a ground terminal;

a second resistor connected between said one of said gate electrodes and a power supply terminal;

a transistor having a collector connected to said one of said gate electrodes, a base connected to said one of said cathode electrodes and an emitter;

a reference voltage supply connected between the emitter of said transistor and said ground terminal; and a voltage divider, connected between said one of said gate electrodes and said ground terminal, an output voltage of said voltage divider being applied to one of said focusing electrodes.

7. A field emission cathode type electron gun as set forth in claim 5, wherein each of said gate control circuits comprises:

a resistor connected between said one of said cathode electrodes and a ground terminal;

an operational amplifier having a first input connected to said one of said cathode electrodes, a second input, and an output connected to said one of said gate electrodes;

a reference voltage supply connected to the second input of said operational amplifier; and a voltage divider, connected between said one of said gate electrodes and said ground terminal, an output voltage of said voltage divider being applied to one of said focusing electrodes.

8. A field emission cathode type electron gun as set forth in claim 5, further comprising:

a third insulating layer formed on said focusing electrodes; and an additional focusing electrode formed on said third insulating layer, a constant voltage being applied to said additional focusing electrode, third openings being formed in said additional focusing electrode and said third insulating layer, each of said third openings leading to one of said second openings.

9. A field emission cathode type electron gun as set forth in claim 2, wherein said gate control circuits comprise a single reference voltage supply as said reference voltage supply.

10. A field emission cathode type electron gun as set forth in claim 3, wherein said gate control circuits comprise a single reference voltage supply as said reference voltage supply.

11. A field emission cathode type electron gun as set forth in claim 6, wherein said gate control circuits comprise a single reference voltage supply as said reference voltage supply.

12. A field emission cathode type electron gun as set forth in claim 7, wherein said gate control circuits comprise a single reference voltage supply as said reference voltage supply.

13. A field emission cathode type electron gun as set forth in claim 1, wherein said substrate comprises an insulating substrate.

14. A field emission cathode type electron gun as set forth in claim 1, wherein said substrate comprises a semiconductor substrate of a first conductivity type, each of said cathode electrodes comprising a semiconductor layer of a second conductivity type opposite to said first conductivity type.

15. A field emission cathode type electron gun comprising:

a plurality of cathode segments, each of said cathode segments including a cathode electrode, a gate electrode, an insulating layer between said cathode electrode and said gate electrode, and a plurality of cone-shaped emitters formed within openings formed in said gate electrode and said insulating layer; and a plurality of gate control circuits, each connected to one of said cathode segments, for detecting a current flowing through said one of said cathode segments and controlling a voltage of the gate electrode of said one of said cathode segments in accordance with said detected current, so that said detected current is brought close to a constant value.

* * * * *